US008635816B2

(12) United States Patent
Lloyd et al.

(10) Patent No.: US 8,635,816 B2
(45) Date of Patent: Jan. 28, 2014

(54) CRAWLSPACE ENCAPSULATION SYSTEM

(75) Inventors: Jeffrey D. Lloyd, Knoxville, TN (US); Michael W. Tobin, Bozeman, MT (US); Ronald T. Schwalb, Knoxville, TN (US)

(73) Assignee: Nisus Corporation, Rockford, TN (US)

( * ) Notice: Subject to any disclaimer, the term of this patent is extended or adjusted under 35 U.S.C. 154(b) by 5 days.

(21) Appl. No.: 13/155,708

(22) Filed: Jun. 8, 2011

(65) Prior Publication Data

US 2011/0302862 A1 Dec. 15, 2011

Related U.S. Application Data

(60) Provisional application No. 61/353,681, filed on Jun. 11, 2010.

(51) Int. Cl.
*E04B 1/00* (2006.01)

(52) U.S. Cl.
USPC ..... 52/169.11; 52/169.1; 52/408; 52/169.14; 52/506.01

(58) Field of Classification Search
USPC ..... 52/169.11, 169.1, 408, 506.01, 169.14
See application file for complete search history.

(56) References Cited

U.S. PATENT DOCUMENTS

| | | | | |
|---|---|---|---|---|
| 4,476,663 | A * | 10/1984 | Bikales | 52/847 |
| 5,678,371 | A | 10/1997 | Wills | |
| 5,704,172 | A * | 1/1998 | Gougeon et al. | 52/169.11 |
| 6,205,718 | B1 * | 3/2001 | Murphy et al. | 52/101 |
| 6,399,109 | B1 * | 6/2002 | Brite et al. | 424/660 |
| 6,423,251 | B1 * | 7/2002 | Blount | 252/609 |
| 6,575,666 | B1 | 6/2003 | Janesky | |
| 6,669,554 | B1 * | 12/2003 | Tregidga | 454/254 |
| 7,247,311 | B2 | 7/2007 | Stein et al. | |
| 7,556,560 | B2 | 7/2009 | Janesky | |
| 7,707,789 | B2 | 5/2010 | Janesky | |
| 7,735,271 | B1 * | 6/2010 | Shipston et al. | 52/169.11 |
| 8,007,205 | B2 * | 8/2011 | Marshall, III | 405/229 |
| 2004/0074178 | A1 * | 4/2004 | Daudet et al. | 52/289 |
| 2005/0161486 | A1 | 7/2005 | Lembo | |
| 2005/0166481 | A1 | 8/2005 | Lembo | |
| 2006/0016139 | A1 * | 1/2006 | Beck et al. | 52/289 |
| 2006/0236639 | A1 * | 10/2006 | Toas | 52/406.2 |
| 2006/0236653 | A1 * | 10/2006 | Showers | 52/794.1 |
| 2007/0157533 | A1 | 7/2007 | Janesky | |
| 2007/0175112 | A1 | 8/2007 | Janesky | |
| 2008/0304921 | A1 | 12/2008 | Langley | |
| 2009/0257830 | A1 | 10/2009 | Marshall, III | |
| 2010/0016468 | A1 * | 1/2010 | Bergstrom | 523/122 |
| 2010/0037546 | A1 * | 2/2010 | Beck et al. | 52/282.4 |
| 2010/0229487 | A1 * | 9/2010 | Lewis | 52/408 |
| 2010/0307101 | A1 * | 12/2010 | Ishaque et al. | 52/741.3 |

FOREIGN PATENT DOCUMENTS

| | | | |
|---|---|---|---|
| EP | 0981956 | A2 | 3/2000 |
| EP | 1159875 | A1 | 12/2001 |

OTHER PUBLICATIONS

Patent Cooperation Treaty, PCT Notification of Transmittal of the International Search Report and the Written Opinion of the International Searching Authority, or the Declaration, Aug. 2, 2012.

* cited by examiner

*Primary Examiner* — Mark Wendell
(74) *Attorney, Agent, or Firm* — Luedeka Neely Group, P.C.

(57) ABSTRACT

A crawlspace encapsulation system that enables sealing and insulating of the crawlspace while allowing for the venting of gases trapped between the ground and the sealing and insulating system. The crawlspace encapsulation system includes an insulation joist plug, one or more insulation panels, and a polymeric membrane.

11 Claims, 5 Drawing Sheets

CRAWLSPACE ENCAPSULATION SYSTEM

CROSS-REFERENCE TO RELATED APPLICATIONS

This application claims the benefit of the earlier filing date of provisional application 61/353,681, filed Jun. 11, 2010.

FIELD

The present disclosure relates to an insulated foundation and subflooring structure. More particularly, the disclosure relates to an insulation structure having improved insulating and venting structure.

BACKGROUND

Many homes are constructed having a crawlspace that is created under the floor of the house as a result of the house being placed on a foundation. Crawlspaces are generally porous and do not provide adequate sealing against moisture and insulating to prevent heat loss and gain. When moisture enters the crawlspace, water enters the wood forming the floor joists and the various other flooring structures above the crawlspace. The moisture can result in a large number of mold spores and create a desirable environment for insects to live. An additional problem relates to preventing insects such as termites from nesting in the crawlspace. Another problem relates to allowing the ventilation of gases, such as radon, while still providing protection against moisture and heat loss and gain. While various attempts have been made to provide suitable sealing and insulating systems, improvement is desired.

Accordingly, the present disclosure relates to an encapsulation system that provides for sealing against moisture, insulating to prevent heat loss and gain, the repelling of insects, and allowing the venting of gases in crawlspaces.

SUMMARY

In a first aspect, the present disclosure provides an insulated foundation and subflooring structure that includes a foundation wall, a sill plate fastened to the top of the foundation wall, a header joist fastened to the top of the sill plate, a first and a second floor joist spaced apart from each other where the floor joists are fastened to the top of the sill plate, and an insulating joist plug compressibly fit between the floor joists and fastened to the top of the sill plate.

In one embodiment, the insulated foundation and subflooring structure includes an insulating joist plug made from a foamed polymer selected from the group consisting of polystyrene, polyurethane, polyethylene, polypropylene, polyisocyanurate, and mixtures thereof. In certain embodiments of the insulated foundation, the insulating joist plug is made of foamed polystyrene.

In certain embodiments of the insulated foundation and subflooring structure, the insulating joist plug is made of a foam polymer having an insecticide dispersed within the foamed polymer. Further, in some embodiments according to the present disclosure, the insulating joist plug is made of a foamed polymer having an insecticide, containing a boron-containing compound, dispersed within the foamed polymer. In one embodiment of the insulated foundation, the boron-containing compound is disodium octaborate tetrahydrate.

In certain embodiments of the foundation and subflooring structure, the insulating joist plug has an R value from about 10 to about 36. Further, in some instances, the insulating joist plug contains one or more slits. The insulated foundation and subflooring structure may also consist of the two floor joists where the two floor joists are substantially parallel to one another and perpendicular to the header joist.

In a second aspect, the present disclosure provides a crawlspace encapsulation system that includes a foundation wall, a sill plate fastened to the top of the foundation wall, a header joist fastened to the top of the sill plate, a first and second floor joist space apart from each other where the floor joists are fastened to the top of the sill plate, an insulating joist plug shaped to compressibly fit between the floor joists, one or more insulating panels fastened to a portion of the foundation wall, and a polymeric membrane that overlaps a portion of the insulating panels and covers the ground adjacent the foundation wall. The polymeric membrane is preferably waterproof and/or resistant to moisture and/or other vapors.

In one embodiment, the encapsulation system includes the insulating panels having a portion that is comprised of one or more venting channels that are connected to the space beneath the polymeric membrane.

In certain embodiments of the encapsulation system, the insulating joist plug and insulating panels are made of a foamed polymer selected from the group consisting of polystyrene, polyurethane, polyethylene, polypropylene, polyisocyanurate, and mixtures thereof. In a particular embodiment, the insulating joist plug and the insulating panels are made from foamed polystyrene.

In certain embodiments, the encapsulation system includes an insulating joist plug and insulating panels made of a foam polymer having an insecticide dispersed within the foamed polymer. In one embodiment, the insulating joist plug and insulating panels are made of a foamed polymer having an insecticide, containing a boron-containing compound, dispersed within the foamed polymer. In a particular embodiment, the boron-containing compound includes disodium octaborate tetrahydrate.

In certain embodiments, the floor joists are substantially parallel to one another and are substantially perpendicular to the header joist.

The encapsulation system preferably has an insulating joist plug with an R value from about 10 to about 36 and insulating panels with an R value from about 5 to about 30. The encapsulation system also preferably is configured such that at least a portion of the insulating panels are separated from one another on one side of the insulating panels. Preferably, the insulating panels have a width of from about 1 to about 24 inches and are fastened to one another by adhesive tape or a polymeric film.

In certain embodiments of the encapsulation system a portion of the insulating panels may be removed to provide access to the foundation wall and sill plate. In one particular embodiment, a portion of the insulating panels includes a hinge that allows the portion to be opened to provide access to the foundation wall and sill plate. In one embodiment, the insulating joist plug may be removed from the encapsulation system to provide access to the foundation wall and the sill plate.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, the disclosure relates to a crawlspace encapsulation system 10 having one or more insulating joist plugs 12 installed above one or more insulating panels 14 and a polymeric ground membrane 16 installed on the floor of the crawlspace.

Figure 3:
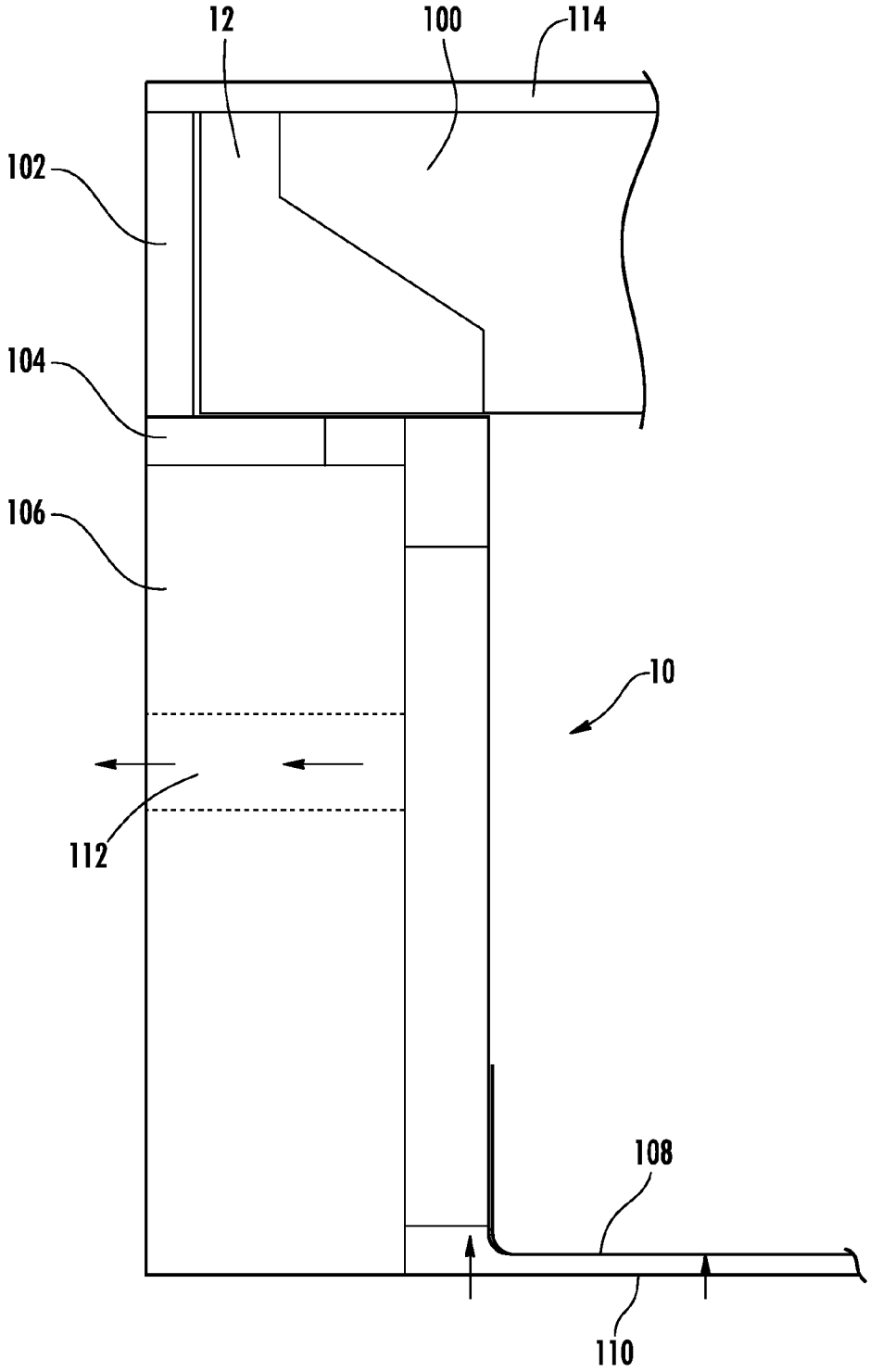
FIG. 3 is a side view of an encapsulation system according to one embodiment of the disclosure.

In a typical foundation and subflooring system, as shown in FIG. 3 for example, the floor 114 is supported by one or more floor joists 100 rest on top of the sill plate 104 and are fastened to a header joist 102 also resting on the sill plate 104. The sill plate 104 is attached to the top of the foundation wall 106. The foundation wall 106 supports the sill plate 104 and flooring joists 100 and is attached to the ground 110. The foundation wall 106 may include a ventilation duct 112 between the interior and exterior of the crawlspace. Any or all of the floor joists 100, header joist 102, sill plate 104, and foundation wall 106 may be chemically treated to provide resistance to termite infestation. For instance, a composition comprising a boron-containing compound (such as disodium octaborate tetrahydrate) and a glycol and/or glycerine may be applied to the outer surfaces of these members.

Figure 2:
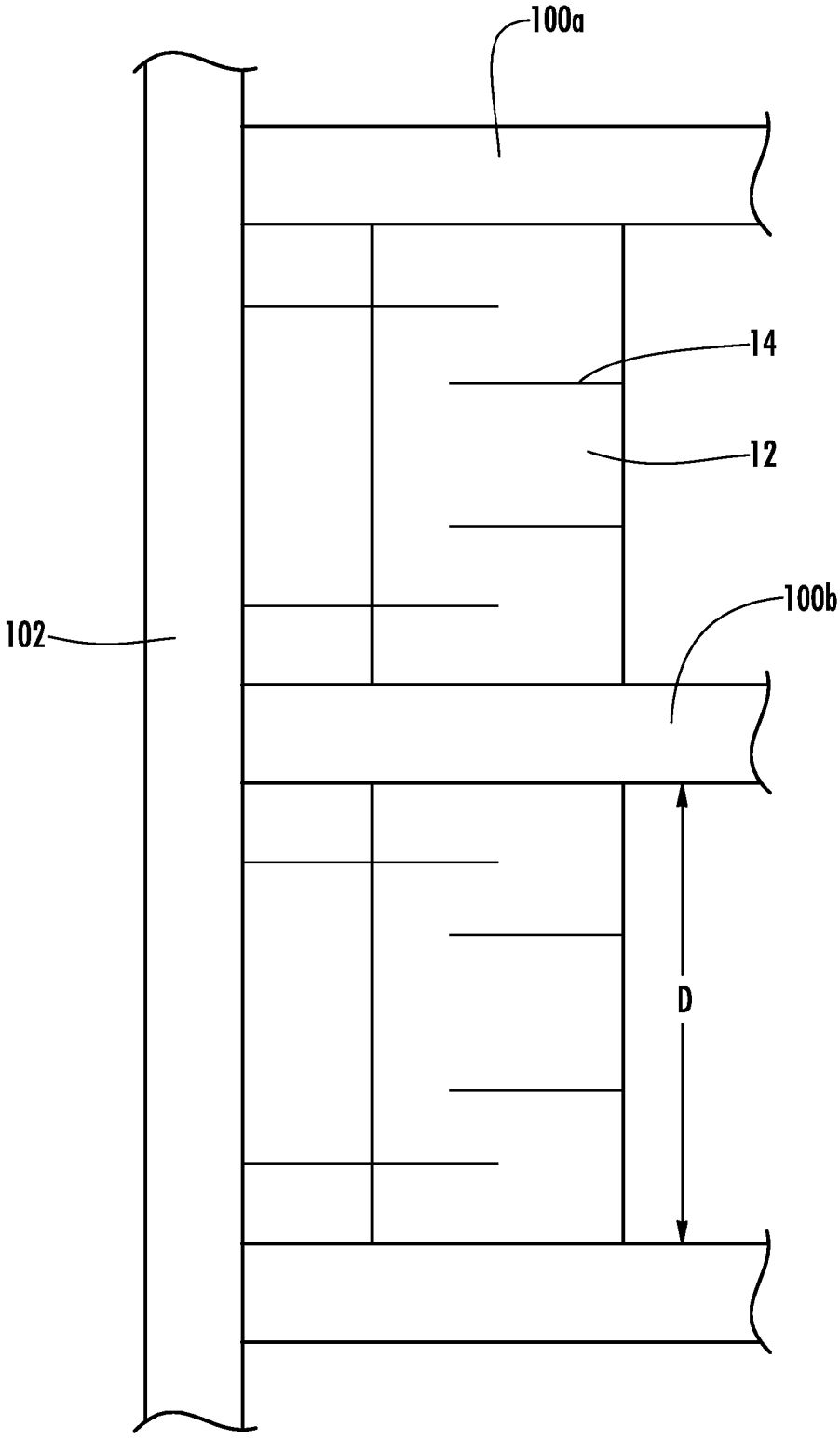
FIG. 2 is a top plan view of the insulating joist plug of FIG. 1.

With reference to FIG. 2, the insulating joist plug 12 is desirably configured to compressibly fit between the floor joists 100*a* and 100*b*. The insulating joist plug 12 is constructed of a foamed polymer such as polystyrene, polyurethane, polyethylene, polypropylene, polyisocyanurate, and like materials. More preferably, the foamed polymer is foamed polystyrene. It is also understood that the insulating joist plug 12 may be constructed of a foamed polymer which includes an insecticide dispersed in the interstitial spaces between the cells or beads of the foamed polymer. For instance, an organic insecticide such as deltamethrin or imidicloprid may be included within the foamed polymer. More preferably, the insecticide may be a boron-containing compound, such as disodium octaborate tetrahydrate. Other suitable boron-containing insecticide compounds include boric acid, sodium borates (such as borax and sodium pentaborate) calcium borates, sodium calcium borates, and mixtures thereof. Certain insects, such as termites, may forage on and damage untreated foamed polymers, or eat wood. The inclusion of such insecticides within the insulating joist plug provides the joist plug with a resistance to termite foraging and damage.

Figure 1:
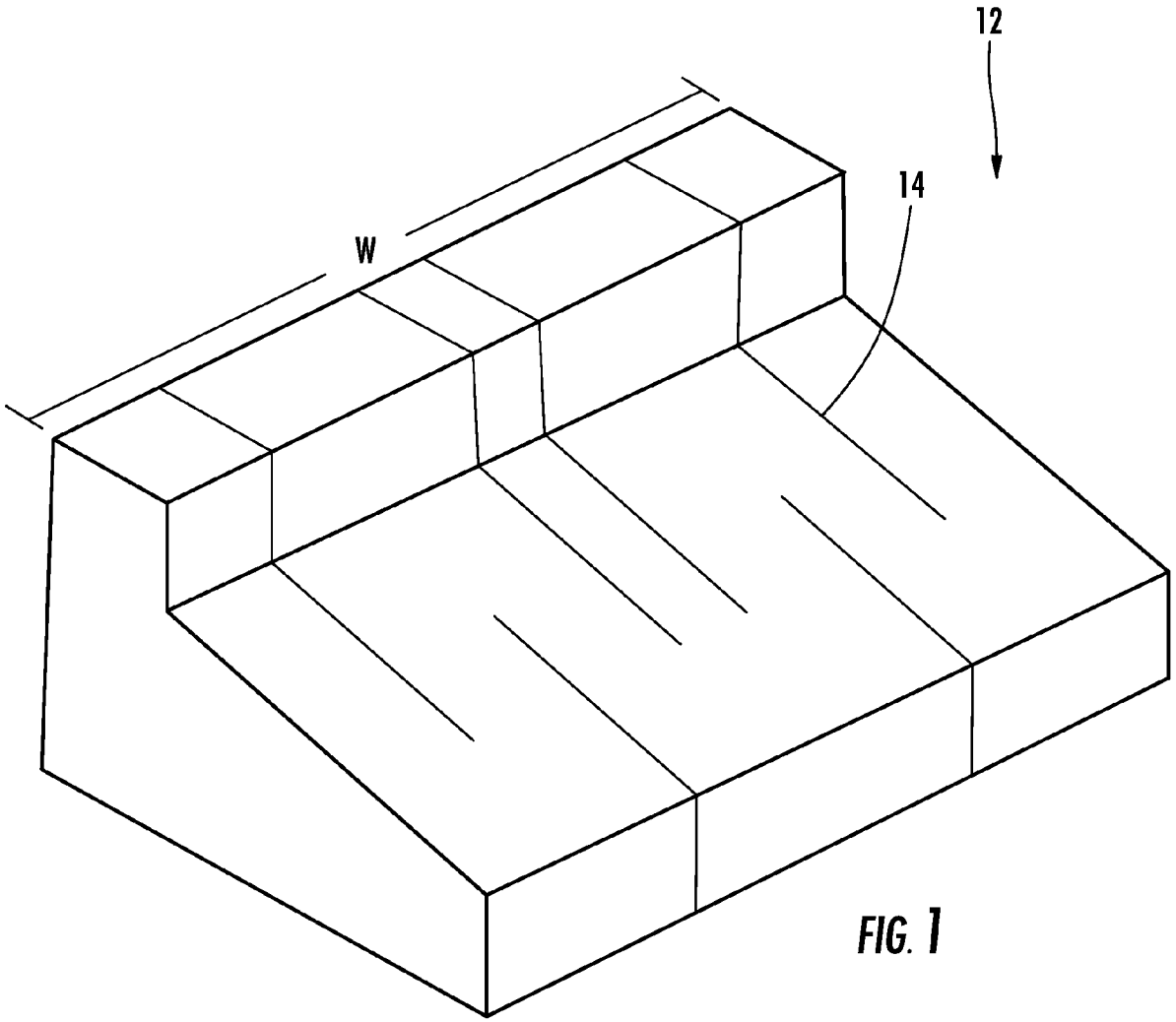
FIG. 1 is a perspective view of an insulating joist plug according to one embodiment of the disclosure.

The insulating joist plug preferably includes a plurality of slits 14 oriented parallel to the floor joists. The slits 14 allow for compression of the insulating joist plug 12 to ensure a tight fit of the insulating joist plug 12 between the floor joists 100*a* and 100*b*. Because of the compression abilities of the insulating joist plug 12, the width W (FIG. 1) of the insulating joist plug 12 may be such that it is equal to or slightly greater than the distance between floor joists D, ensuring a secure fitting of the insulating joist plug 12. In typical modern framing, floor joists are generally placed about 16 inches apart from center to center. Allowing for the thicknesses of the floor joists, this means that the width W of the insulating joist plug will generally be from about 14" to about 15" inches.

The insulating joist plug 12 is preferably configured to rest above of the sill plate 104 and to sit adjacent to the header joist 102. The insulating joist plug generally has a thickness from about 2½" to about 10" inches and provides an insulating R value of from about 10 to about 36.

The encapsulation system 10 also includes a plurality of insulating panels 14. The insulating panels 14 may be formed from the same polymeric materials as the insulating joist plugs 12, although the thickness and other dimensions of the panels 14 may differ from those of the joist plugs 12. For instance the insulating panels 14 may be constructed of a foam polymer such as polystyrene, polyurethane, polyethylene, polyproplyene, polyisocyanurate, and like materials. More preferably, the foamed polymer is foamed polystyrene. The insulating panels 14 may also include an insecticide as in the insulating joist plug 12. Preferred insecticides include boron-based compounds such as disodium octaborate tetrahydrate. The insulating panels generally provide an insulating R value of from about 5 to about 30.

Figure 4:
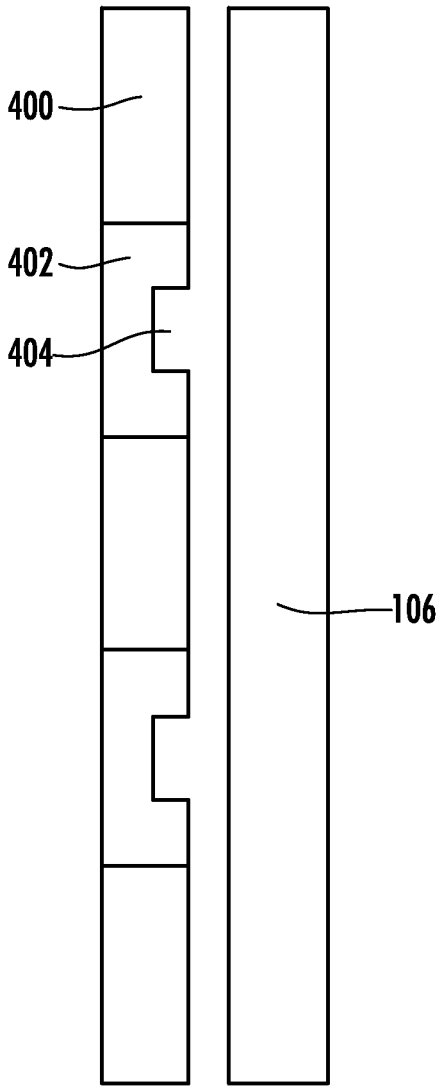
FIG. 4 is a top plan view of the insulating panels having venting channels adjacent the foundation wall according to one embodiment of the disclosure.

In one embodiment, shown in FIG. 4, the insulating panels 14 may be configured such that alternating rectangular insulated panels 400 and one or more vented insulating panels 402 are placed adjacent to each other. The vented insulating panels 402 preferably include a vent channel 404 that is oriented such that the open side of the vent channel is directly adjacent to the foundation wall 106. The vent 404 is also preferably oriented such that it traverses the vertical length of the insulating panel 402 from the bottom of the insulating panel 402 to the top of the insulating panel 402 near the floor joist 100 and such that the vent 404 comes in contact with the ventilation duct 112 of the foundation wall 106. The insulating panels 14 may be configured for installation individually or such that the insulating panels 14 are attached to one another by an adhesive tape or polymeric film attached on one side of the insulating panels 14. Attachment of the insulating panels 14 to one another by an adhesive tape or polymeric film allows the insulating panels 14 to fold so that they may be placed into the crawlspace for installation.

Figure 5:
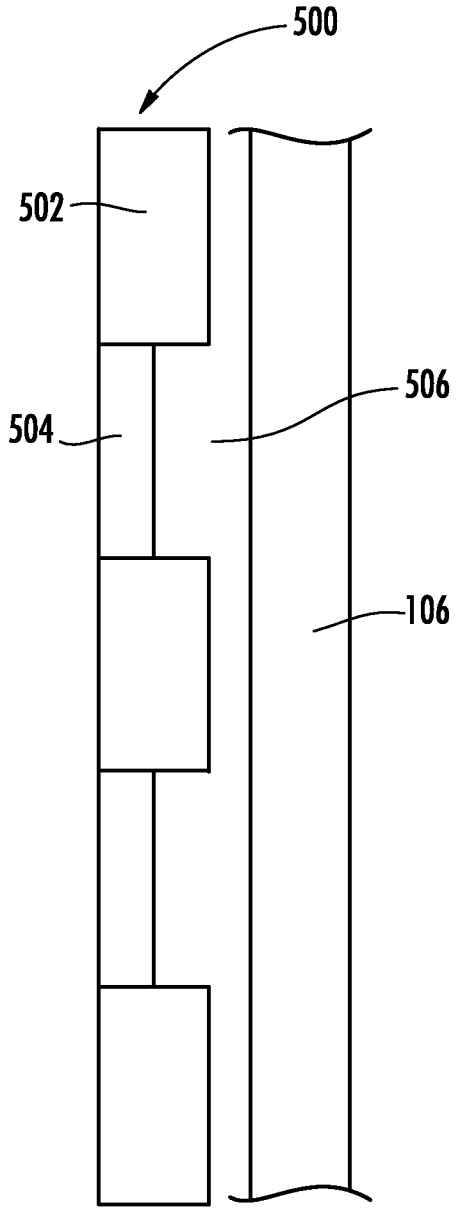
FIG. 5 is a top plan view of an alternate embodiment of an insulating panel having individual panels of varying thickness to create venting channels according to one embodiment of the disclosure.

In an alternative embodiment, shown in FIG. 5, the insulating panels 14 may also be configured such that an alternating panel 502 is of a different thickness than the adjacent insulating panel 504. The insulating panels with a lesser thickness 504 than the adjacent panels 502 create a vent channel 506 directly adjacent to the foundation wall 106.

Figure 6:
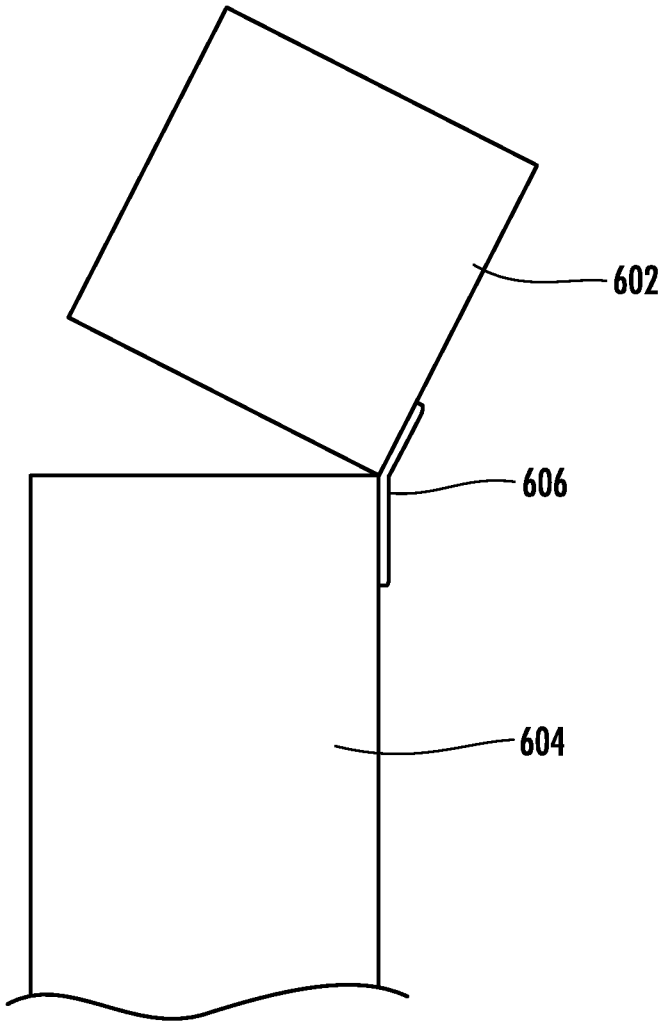
FIG. 6 is a side view of the insulating panel of FIG. 4 showing the hinged portion of the panel providing access to the foundation wall and sill plate according to one embodiment of the disclosure.

With reference to FIG. 6, the insulating panels 14 may include a removable panel 602 located at the top of the insulating panel 14. The removable panel 602 is preferably configured to allow access to the foundation wall 106 and the sill plate 104. The removable panel 602 preferably rests on top of the lower portion of the insulating panel 604 and may be configured to be completely removed during inspection and repair of the foundation wall 106. The removable panel 602 may then be reinstalled upon completion of inspection and repair. It is also understood that the removable panel 602 may be attached to the lower portion of the insulating panel 604 through use of an adhesive tape, polymeric film, 606 or similar means, allowing the removable panel 602 to hinge with respect to the lower portion of the insulating panel 604.

In a particularly preferred embodiment, the insulating panel 14 may be provided as a panel having a width of approximately eight feet and a height of approximately four feet. Both surfaces of the panel 14 are preferably laminated with a polymer film, such as a polyethylene film. Before being laminated, however, the panel 14 is preferably scored across its width at approximately one foot intervals. The panel 14 may then be easily cut along one of the score lines to remove a portion of the panel so as to provide an appropriate size for a particular crawlspace installation. Alternatively, the panel may be cut along one of the score lines, while leaving the laminated film intact, thereby providing a hinge. In this way a portion of the panel 14 may also be temporarily folded back along one of the score lines to facilitate inspection of the foundation hidden behind the panel.

With reference to FIG. 3, the polymeric membrane 108 may preferably be installed on the ground of the crawlspace adjacent the foundation wall 106. The polymeric membrane 108 may be fastened to the insulating panels 14 on the second side facing the crawlspace such that the polymeric membrane overlaps at least a portion of the insulating panels 14 forming a substantially airtight seal. The overlap and seal of the polymeric membrane 108 over the insulating panels 14 ensures that no moisture or other gas will be allowed to pass from the ground to the crawlspace The polymeric membrane is preferably composed of a polymer such as polyethylene or polypropylene, and generally has a thickness from about 1 to about 5 mils. The polymeric membrane acts as a barrier to undesired vapors, such as water vapor and radon. In some instances, the polymeric membrane may also be waterproof.

The crawlspace encapsulation system creates a waterproof barrier between the crawlspace and the ground. When gases (such as radon gas) and moisture rise from the ground, the gases and moisture may occupy the space between the polymeric membrane 108 and the ground 110. The polymeric membrane 108 prevents the moisture and gases from entering the crawlspace and allows the gases and moisture to travel to the insulating panels 14 and enter the vent channel 404. The moisture and gases then travel through the vent channel to a ventilation duct 112 in the foundation wall 106 where it passes outside.

According to the present disclosure, the insulating joist plug preferably has with an R value from about 10 to about 36. The insulating panels preferably have an R value from about 5 to about 30, and more preferably from about 10 to about 15.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. A crawlspace encapsulation system comprising:

a foundation wall;

a sill plate fastened to a top portion of the foundation wall;

a header joist fastened to a top portion of the sill plate;

at least a first floor joist and a second floor joist spaced apart from the first floor joist, wherein both the first and second floor joists are fastened to the top of the sill plate; and an insulating joist plug disposed adjacent the header joist and above the sill plate, wherein the insulating joist plug includes a plurality of slits formed in the joist plug which allow the plug to compressibly fit between the first and second floor joists;

a plurality of insulating panels, each having a first and an opposing second side, fastened to at least a portion of the foundation wall with the first side of the insulating panels adjacent the foundation wall; and a polymeric membrane fastened to the second side of the insulating panels, wherein the polymeric membrane is disposed over at least a portion of the second side of the insulating panels and also disposed over ground adjacent the foundation wall and wherein the insulating joist plug comprises a foamed polymer having an imidacloprid or boron-containing insecticide dispersed therein and wherein at least a portion of the insulating panels further comprise at least one venting channel adjacent the foundation wall which is in flow communication with the ground beneath the polymeric membrane and with at least one ventilation duct in the foundation wall.

2. The encapsulation system of claim 1, wherein the insulating joist plug and the insulating panels comprise a foamed polymer selected from the group consisting of polystyrene, polyurethane, polyethylene, polypropylene, polyisocyanurate, and mixtures thereof.

3. The encapsulation system of claim 2, wherein the insulating joist plug and the insulating panels comprise foamed polystyrene.

4. The encapsulation system of claim 1, wherein the boron-containing compound comprises disodium octaborate tetrahydrate.

5. The encapsulation system of claim 1, wherein the first and second floor joists are substantially parallel to one another and substantially perpendicular to the header joist.

6. The encapsulation system of claim 1, wherein the insulating joist plug has an R value from about 10 to about 36 and insulating panels have an R value from about 5 to about 30.

7. The encapsulation system of claim 1, wherein at least a portion of the insulating panels are separated from one another on the first sides of the insulating panels.

8. The encapsulation system of claim 1, wherein at least a portion of the insulating panels have a width of from about 1 to about 24 inches and are fastened to one another by adhesive tape or polymeric film adhered to the second sides of the insulating panels.

9. The encapsulation system of claim 1 wherein at least a portion of the insulating panels may be removed from the encapsulation system to provide access to the foundation wall and the sill plate.

10. The encapsulation system of claim 1, wherein at least a portion of the insulating panels comprised a hinged portion which may be opened to provide access to the foundation wall and the sill plate.

11. The encapsulation system of claim 1, wherein the insulating joist plug may be removed from the encapsulation system to provide access to the foundation wall and the sill plate.

* * * * *